US011198982B2

(12) United States Patent
Hoffmann

(10) Patent No.: US 11,198,982 B2
(45) Date of Patent: Dec. 14, 2021

(54) SKID WHEEL SYSTEM

(71) Applicant: Michael R. Hoffmann, Clive, IA (US)

(72) Inventor: Michael R. Hoffmann, Clive, IA (US)

( * ) Notice: Subject to any disclaimer, the term of this patent is extended or adjusted under 35 U.S.C. 154(b) by 305 days.

(21) Appl. No.: 16/446,997

(22) Filed: Jun. 20, 2019

(65) Prior Publication Data

US 2019/0390423 A1 Dec. 26, 2019

Related U.S. Application Data

(60) Provisional application No. 62/687,556, filed on Jun. 20, 2018.

(51) Int. Cl.
*E01H 5/06* (2006.01)

(52) U.S. Cl.
CPC ..... *E01H 5/066* (2013.01)

(58) Field of Classification Search
CPC ..... E01H 5/065; E01H 5/066
See application file for complete search history.

(56) References Cited

U.S. PATENT DOCUMENTS 1,887,451 A * 11/1932 Dombrowski ..... E01H 5/066 37/270
2,202,309 A * 5/1940 Campbell ..... B62B 19/00 280/28
2,513,266 A * 6/1950 Laukus, Sr. ..... B61F 3/08 105/182.1
2,611,979 A * 9/1952 Weller ..... E01H 5/066 37/270
3,078,603 A * 2/1963 Ertsgaard ..... E01H 5/04 37/252
3,267,594 A * 8/1966 Mattson ..... E01H 5/04 37/246
3,742,626 A * 7/1973 Ellis ..... E01H 5/045 37/260
4,756,102 A * 7/1988 Chapman ..... E01H 1/04 172/719
5,438,770 A * 8/1995 Miller ..... E01H 5/04 37/227
6,508,018 B1 * 1/2003 O'Brien ..... E01H 5/04 37/223
6,952,893 B1 * 10/2005 Sanderson ..... E01H 5/045 37/261
7,137,214 B2 * 11/2006 Hoerle ..... E01H 5/04 37/242
D657,395 S * 4/2012 Bauer ..... D15/11
8,191,289 B2 * 6/2012 Raftery ..... E01H 5/12 37/271

(Continued)

*Primary Examiner* — Jamie L McGowan

(57) ABSTRACT

A skid wheel system that has a shoe with two wheels attached. The first wheel is positioned adjacent to one side of the shoe and the second wheel is positioned adjacent to the other. The skid shoe has at least one connection opening to connect the skid shoe to a snow removal device. The circumferential edges of the wheels extend past at least the bottom, and protrude beyond the sides of the skid shoe, so as to protect the bottom, front and rear of the housing of the snow removal device from contact with concrete seams, and other uneven surfaces. The wheels can also, extend past the top of the shoe, so the system can be removed, rotated, and reattached in the event the bottom of the shoe wears to the point of no longer protecting the bottom of the snow removal device.

15 Claims, 3 Drawing Sheets

(56) References Cited

U.S. PATENT DOCUMENTS

| | | | | |
|---|---|---|---|---|
| 8,544,856 | B2 * | 10/2013 | Sayre | E01H 5/066 280/28.17 |
| 8,584,383 | B1 * | 11/2013 | Morse | E01H 5/098 37/244 |
| D694,780 | S * | 12/2013 | Raftery | D15/11 |
| 9,598,829 | B2 * | 3/2017 | Betts | E01H 5/098 |
| 9,982,404 | B2 * | 5/2018 | Maile | B62B 17/02 |
| 10,208,442 | B2 * | 2/2019 | Mast | E01H 5/045 |
| 2005/0066553 | A1 * | 3/2005 | Light | E01H 5/04 37/242 |
| 2007/0193073 | A1 * | 8/2007 | Doak | E01H 5/066 37/270 |
| 2008/0189990 | A1 * | 8/2008 | Luhtanen | E01H 5/04 37/249 |
| 2011/0314707 | A1 * | 12/2011 | Raftery | E01H 5/045 37/224 |
| 2011/0315465 | A1 * | 12/2011 | Henry | E01H 5/098 180/182 |
| 2012/0074662 | A1 * | 3/2012 | Sayre | E01H 5/066 280/28.17 |
| 2015/0068074 | A1 * | 3/2015 | Mast | E01H 5/045 37/197 |
| 2017/0247847 | A1 * | 8/2017 | Maile | E01H 5/098 |
| 2018/0127935 | A1 * | 5/2018 | Paonessa | E01H 5/062 |

* cited by examiner

SKID WHEEL SYSTEM

CROSS REFERENCE TO RELATED APPLICATION

This application claims the benefit of the priority of U.S. Provisional Application No. 62/687,556 filed on Jun. 20, 2018, the contents of these applications are hereby incorporated by reference in their entirety.

BACKGROUND OF THE INVENTION

This invention is directed toward snow removal devices. More specifically, and without limitation, this invention relates to skid wheel system for a snow removal device.

Mechanized snow removal devices, such as snow blowers and snow plows are well known in the art. Due to the costs related to replacement, skid shoes have been developed to avoid or limit damage caused by engagement between the metal components of the snow removal device and the ground, which is usually an abrasive material, such as concrete.

Skid shoes attach to a lower portion of the snow removal device and extend below the blade or housing to prevent engagement with the ground. When attached to a housing of a snow blower or an inverted blade, which resembles the housing of a snow blower, the skid shoes have a flat elongated bottom that in many instances is wider than the remainder of the device. When a blade is used for snow removal, the skid shoes are placed below a lower edge and usually have a circular pad that is connected to a post, which connects to the blade.

Skid shoes, however, have deficiencies. To begin, the static position of the skid shoe in both instances results in the skid shoes wearing quickly. This is especially true due to the hard plastic or metal materials used. As a result, the shoe needs to be adjusted or replaced on a frequent and costly basis.

To address this deficiency, many skid shoes can be removed, rotated, and reattached so that an elongated top that resembles the elongated bottom is positioned to engage the concrete. This advancement still requires consistent maintenance, adjustment, and replacement as the skid shoes quickly wear.

Another deficiency of these skid shoes is that they do not facilitate movement. Rather, the elongated portion that engages the ground is either pushed or drug across the ground resulting in scraping and excessive noise. This in turn contributes to the skid shoes rapidly wearing and making operation of the snow removal device more difficult, especially when being manually manipulated by an individual without the assistance of a vehicle or self-propelled system.

One advancement has been the addition of a single wheel that extends slightly below the bottom surface or extends in the same lower horizontal plane as the skid shoe, but is positioned behind the skid shoes along the same vertical plane. This design, however, is problematic for a host of reasons. To begin, the torque applied to the single wheel causes the wheel to bow out. As a result, the wheel can be damaged or is worn in a non-uniform manner hastening the need for replacement and diminishing any benefit provided by the single wheel.

Additional problems are also present. In particular, some embodiments pass through an opening in the elongated bottom of the skid shoe, which reduces the efficiency of the skid shoe and can lead to buildup of snow as it is engaged by the remaining parts of the elongated bottom. The wheels also have a static position and have a substantially flat outer surface. As a result, the wheels still wear quickly and once the flat outer surface is worn away, the wheel is of little to no use. Further, the wheels are connected in a rudimentary fashion, such as a simple bolt extending through an opening in the otherwise hard plastic wheel. This leads to freezing and rusting of the bolt, which leads to the wheel not rotating and wearing down in only one location so that the outer surface becomes flat in that spot and essentially drags across the ground much like a skid shoe. Rusting also inhibits the ability to perform repairs due to the denigration of the nut and bolt.

Still further, a single wheel does not adequately prevent damage from occurring to either the skid shoe or the snow removal device. For instance, if the wheel is positioned to the front of the device's housing, the rear of the housing is damaged when uneven surfaces are encountered or the device is tilted. Likewise, when the wheel is positioned toward the back, the front is damaged.

Thus it is a primary objective of this invention to provide a skid wheel system that improves upon the art.

Another objective of this invention is to provide a skid wheel system that reduces or avoids wear to a snow removal device.

Yet another objective of this invention is to provide a skid wheel system that avoids or reduces freezing and rusting.

Another objective of this invention is to provide a skid wheel system that allows independent adjustment of the skid wheel system.

Yet another objective of this invention is to provide a skid wheel system that extends the longevity of a snow removal device.

Another objective of this invention is to provide a skid wheel system that assists a snow removal device in traversing a terrain.

Yet another objective of this invention is to provide a skid wheel system that reduces wear related to scraping.

These and other objectives, features, and advantages of the invention will become apparent from the specification and claims.

SUMMARY OF THE INVENTION

In general, the present invention relates to a skid wheel system. The skid wheel system includes a skid shoe and a first skid wheel and a second skid wheel. The first skid wheel is positioned adjacent a first side of the skid shoe and the second skid wheel is positioned adjacent a second side of the skid shoe. The skid shoe has at least one connection opening that is configured to connect the skid shoe to a snow removal device with a connection member. In some arrangements the skid shoe has three or more connection openings. The circumferential edge of the first skid wheel and the second skid wheel extends past at least a bottom of the skid shoe in order to mitigate wear and damage caused by engagement of a ground surface with the skid shoe and the snow removal device while improving traversal of the snow removal device over the ground surface.

In this arrangement, the first skid wheel and the second skid wheel stabilize the snow removal device to limit damage to the skid shoe, which results from only a single skid wheel being present. Also, the use of two skid wheels provides the unique advantage of reducing torque applied to the skid wheels such that the wheels do not bow out.

In some embodiments, the circumferential edge of the first skid wheel and the second skid wheel extends past the top and the sides of the skid shoe as well. In this way, the first skid wheel and the second skid wheel protect the skid shoe from damage on all sides.

In some arrangements, the first skid wheel and the second skid wheel are connected to the skid shoe adjacent opposing sides by way of a connection member received through a central opening in each skid wheel and a wheel connection opening in the skid shoe. In this way, the skid wheels further protect and stabilize the skid shoe and snow removal device.

In some embodiments of the present invention, the connection openings in the skid shoe are positioned between opposing wheel connection members. This arrangement allows the skid shoe to be selectively connected to the snow removal device while maintaining superior protection of the skid shoe.

In some arrangements, a spacer is positioned between the skid wheels and the skid shoe. In this way, the spacer positions the skid wheels away from the skid shoe so that the skid wheels do not contact one another during operation, including when turning the snow removal device. This in turn provides the unique benefit of improving the traversal of the snow removal device over the ground surface, such as concrete and snow, while also preventing wear caused by contact between the skid shoe and skid wheels.

In some embodiments, the skid shoe has an outer ridge that extends around at least a portion of an exterior of the skid shoe. The outer ridge increases the longevity of the skid shoe while also increasing the surface of the skid shoe that will contact the ground surface in instances where the skid wheels are unable to prevent contact. In turn, this limits damage or wear occurring to the snow removal device.

A further advantage in some arrangements of the present invention is the presence of the skid wheels having a tire and bearing. The bearing facilitates rotation of the wheel and thereby improves traversal of the snow removal device and eliminates the need to drag the skid shoe along the ground surface. In some embodiments, the tire is a polyurethane having a hardness of 85 A, which provides superior protection against wear while avoiding brittleness harder polyurethanes experience at cold temperatures typically associated with the presence of snow. In some arrangements, the tire has a rounded profile that limits the amount of the tire that engages the ground surface while simultaneously improving the ability for the snow removal device to turn and move over seams commonly found in concrete resulting in the ground surface being positioned significantly higher or lower.

In some embodiments of the skid wheel system, one or more connection openings is elongated in a vertical direction between the top and the bottom of the skid shoe. This allows the skid shoe to be selectively positioned along the length of the connection opening, which allows the amount of the skid shoe, and thereby the skid wheels, to extend past a bottom edge of the snow removal device's hood.

DETAILED DESCRIPTION

Figure 1:
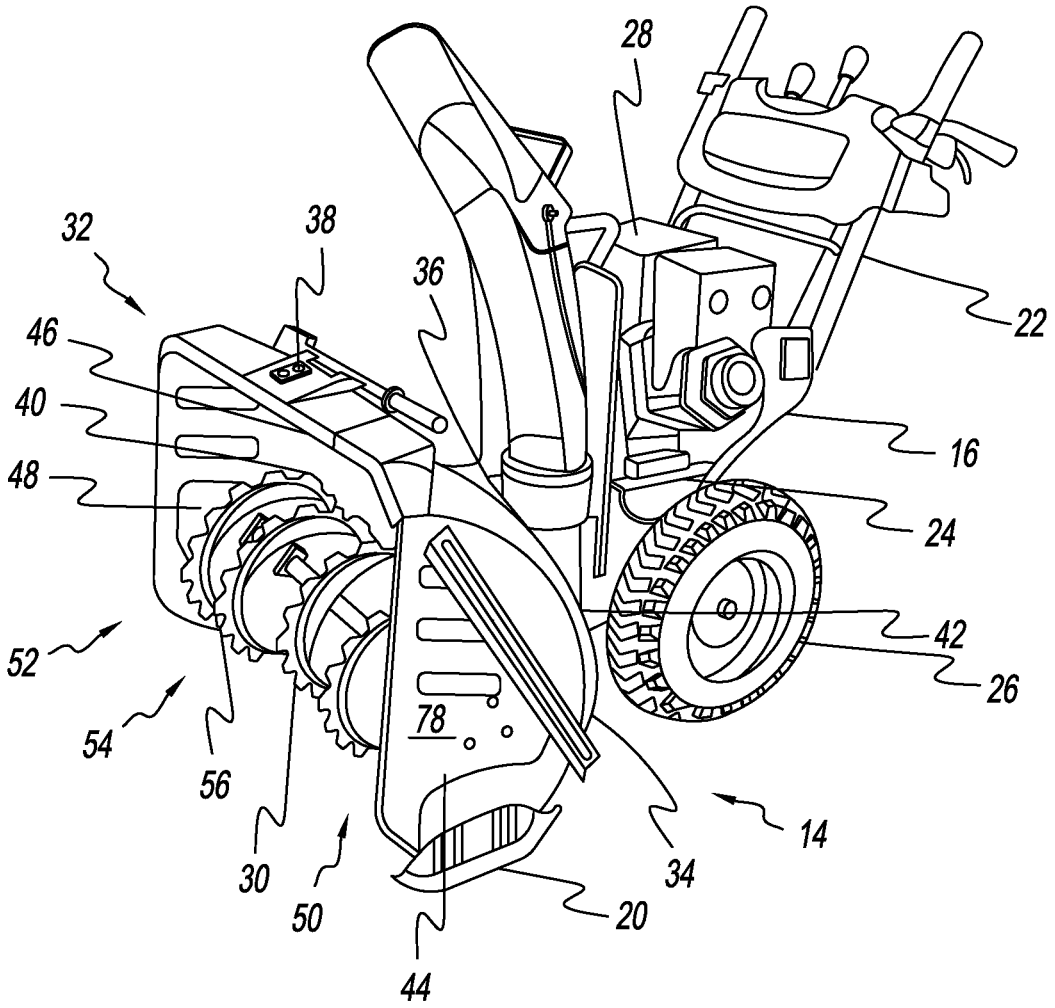
FIG. 1 (Prior Art)
FIG. 1 is a perspective view of a prior art skid shoe system connected to a snow blower.

With reference to the figures a skid wheel system 10 is shown having two or more skid wheels 12 connected to a snow removal device 14, such as a snow blower 16 or a snow plow 18, and in some instances one or more skid shoes 20 attached to the snow removal device 14. Particular embodiments of the present invention have the skid wheels 12 selectively and independently connected to the skid shoes 20 or snow removal device 14 as detailed further below.

The snow blower 16 conventionally has a handle 22 connected to a body 24. A pair of snow blower wheels 26 are also connected to the body 24. The body 24 encases at least a portion of an engine 28. The engine 28 is attached to a removal device, such as an auger 30. The body 24 also has a housing 32 that extends from the body 24 in a direction opposite of the handle 22 and in this way protects an individual who is using the snow blower 16 from interacting with the removal device 30.

As seen in FIG. 1, the housing 32 has a back panel 34 with an orifice 36 that the removal device 30 operatively connects to the engine 28. The back panel 34 extends in a generally vertical direction and is positioned between the individual operating the snow blower 16 and the removal device 30. In some arrangements, a hood 38 is attached to or is an extension of the back panel 34 such that a top 40 of the removal device 30 is covered. Extending vertically downwards from a first edge 42 of the back panel 34 and the hood 40 is a first side panel 44 and extending vertically downwards from a second edge 46 of the back panel 34 and the hood 38 is a second side panel 48. In this way, a bottom 50 and a front 52 of the housing 32 is open thereby forming a partial chamber 54.

The chamber 54 is configured to channel snow or other debris into the housing 32 to be removed in a conventional fashion without snow escaping the sides of the housing 32 that is blocked by the first side panel 44 and the second side panel 48.

Connected to a bottom edge 56 of the first side panel 44 and the second side panel 48, or both, is the skid shoe 20. The skid shoe 20 has a skid body 58 that extends from a front 60, a back 62, a bottom 64, a top 66, a first side 68, and a second side 70, and in some arrangements has a generally flat planar shape. In some embodiments, an outer ridge 72 extends around an exterior of the skid body 58 or at least a portion along the bottom 64, the top 66, or both. The outer ridge 72, in some instances, has a width that is greater than the rest of the skid body 58, such that the outer ridge 72 extends beyond the front 60, the back 62, or both, such that the skid body 58 is recessed in relation to the outer ridge 72.

Passing through the front 60 to the back 62 are one or more connection openings 74 and one or more wheel connection openings 76. The connection openings 74 and wheel connection openings 76, in some embodiments, extend vertically in an elongated manner along a length from the top 66 and the bottom 64 such that a width of the connection openings 74 and wheel connection openings 76 is less than the height of each. In some embodiments, such as that shown in the exemplary embodiments of the Figures, the connection openings 74 are elongated but the wheel connection openings 76 are not, rather the wheel connection openings 76 are circular.

As depicted in the exemplary embodiment shown in the Figures, the skid body 58 has multiple connection openings 74 and two wheel connection openings 76. The connection openings 74 are located between the wheel connection openings 76 and the first side 68 and second side 70 of the skid body 58. In this configuration, each wheel connection opening 76 is positioned between one side 68 or 70 of the skid body 58 and one of the connections openings 76.

The skid shoe 20, in one arrangement, is connected to an outer surface 78 of the respective side panel 44 or 48 of the housing 32. For instance, the skid shoe 20 in one arrangement is positioned with the first side panel 44 between the skid shoe 20 and the removal device 30. The skid shoe 20 is positioned so that a portion of the skid shoe 20 extends below the edge 42 or 46 of respective side panel 44 or 48. This permits the skid shoe 20 to engage the ground and prevent the housing 32 to engage the ground.

To connect the skid shoe 20 to the housing 32, one or more connection member 80 is passed through the skid shoe 20 and into one of one or more openings 82 (not shown) in the respective side panel 44 or 48. As shown in the exemplary embodiment, the connection member 80 is a bolt that also passes through one or more connector or spacer 81, such as a nut, a washer, and the like where the connection member 80 is passed from the front 60 of the skid body 56 through one of the connection openings 74 and one of the openings 82 (not shown) in the respective side panel 44 or 48. In embodiments having elongated connection openings 74, the connection member 80 is selectively positioned and fastened to selectively connect the skid body 58 to housing 32 at the desired spot along the length of the connection opening 74.

Connected to the skid shoe 20 are at least two skid wheels 12. The skid wheels 12 have a tire 84 and a bearing 86. The tire 84 in some embodiments is made of a polyurethane with a hardness of 85 A, which allows for reduced wear compared to plastic tires and polyurethane tires with higher hardness levels that are also prone to becoming brittle at colder temperatures and can break. An outer surface 88 of the tire 84 has a rounded profile 90 when viewed from the front. The rounded profile 90 limits the amount of the tire 84 that engages the ground, and also facilitates movement and turning of the snow removal device 14. In some embodiments a diameter of the skid wheels 12 is 90 mm.

The skid wheel 12 has a central opening 92 that also receives one of the connection members 80. The use of the bearing 86, however, reduces issues related to the connection member 80 freezing to the skid wheel 12 or rusting. In one instance of the present invention, one or more spacer 81 is positioned on one or both of the first side 68 and the second side 70 of the skid wheel 12, which provides the unique benefit of reducing the likelihood of rust forming on the connection member 80 and the benefit of positioning the skid wheel 12 away from the skid shoe 20 to avoid rubbing between the two.

Each skid wheel 12 is connected to the skid shoe 20 by passing one connection member 80 through one wheel connection opening 76 and the central opening 92 of the skid wheel 12. As shown in the exemplary embodiment of the Figures, the connection member 80 is a bolt that passes through in such a manner that the nut is attached to the bolt and engages the skid wheel 12.

To adjust the position of the skid wheel 12, the skid wheel 12 and connection member 80 are slid up and down along the length of the wheel connection opening 76 until the skid wheel 12 is in the desired position and then secured, for instance, by tightening. In one arrangement, the skid wheel 12 is positioned so one-eighth of an inch extends beyond the bottom 64 of the skid shoe 20, which provides clearance of most surfaces for the rest of the snow removal device 14. When connected, each skid wheel 12 is positioned outside the skid shoe 20 such that the skid wheel does not engage or pass through any vertical plane of the skid shoe 20, which limits accumulation of snow or other debris that could inhibit the rotation of the skid wheel 12.

In embodiments utilizing elongated wheel connection openings 76, selective and independent adjustment of each skid wheel 12 along the length of each wheel connection opening 76 and further allows for separately adjusting the height of the skid shoe 20 along the length of the connection opening 74 that connect the skid shoe 20 to the housing 32. In other arrangements, each skid wheel 12 is fixedly connected to the skid shoe 20 at predefined locations, such that independent and selective adjustment is not possible.

The skid wheels 12 not only contact the surface being cleaned, but also, seams when moving forward and backward at an angle towards the seam other than parallel to the seam, thereby avoiding contact with the housing 32. As the skid wheels 12 wear, the skid shoe 20 is lowered so the housing 32 continues to avoid contact with the surface. In some arrangements, the skid wheels 12 are replaced when the diameter has been reduced by half in relation to the original diameter of the skid wheel 12. As seen in the Figures, in some arrangements, the skid wheels 12 are positioned equidistant from the top 66, the bottom 68, and one side 68 or 70 of the skid body 58, so as to leave the outer circumferential edge of the skid wheel 12 protruding beyond the skid body 58.

In another embodiment, the skid wheels 12 are not connected to the skid shoe 20, but instead connected directly to the housing 32 or a contact mount plate 33 (not shown). In these arrangements, the overall width of the skid wheel system 10 and the housing 32 is less than when a skid shoe 20 is present, i.e., the overall track width is smaller, which in turn reduces the bending force on the housing 32. The contact mount plate 33 (not shown), in some arrangements, is sized and shaped to distribute the force on the housing 32 to avoid bending. Alternatively, the skid shoe 20 can be connected to the contact mount plate 33 to provide additional protection from bending and surface contact—however, the track width is not as small.

The adjustment of the skid wheels 12 position along the length of the wheel connection openings 76 also increases the longevity of the skid wheels 12 prior to replacement. When one or more skid wheel 12 wears to a point that any other part of the housing 32 will consistently engage the ground, the connection member 80 is removed or loosened to lower the skid wheel 12 so that the skid wheel 12 provides sufficient clearance for the rest of the housing 32. This operation can be carried out anywhere, but is facilitated by being done on a level smooth surface. The simple adjustment of the skid wheel 12 position allows for skid wheels 12 to be used until the tire 84 is worn to the bearing 86, or approximately half the diameter of the skid wheel 12.

In other embodiments, the housing 32 has at least two wheel connection openings 76 that allow for the selective and independent connection of the skid wheels 12 without the presence of the skid shoes 20.

When both skid wheels 12 are connected, the position of the wheel connection openings 76 position the skid wheels 12 at or adjacent to the first side 68 and the second side 70 of the skid body 58. This provides protection to the front and back of the housing 32 of the snow removal device 14. The use of only a single wheel provides less uniform support of the skid shoe 20 resulting in unnecessary wear and damage to the housing 32 among other problems such an arrangement causes as described herein.

In some embodiments utilizing snow plows 18 similar configurations to those with a snow blower 16 is present. Primarily, snow plows 18 that use an inverted scoop 94 (not shown) have a shape substantially similar to that of a snow blower 16 housing 32, except there is not always a removal device 30, an orifice 36, and the hood 38 of the housing 32 can be partial or absent. However, in each of these arrangements, the inverted scoop 94 includes the first side panel 44 and the second side panel 48, which allows for connection of the skid wheel 12 with or without a skid shoe 20.

Figure 2:
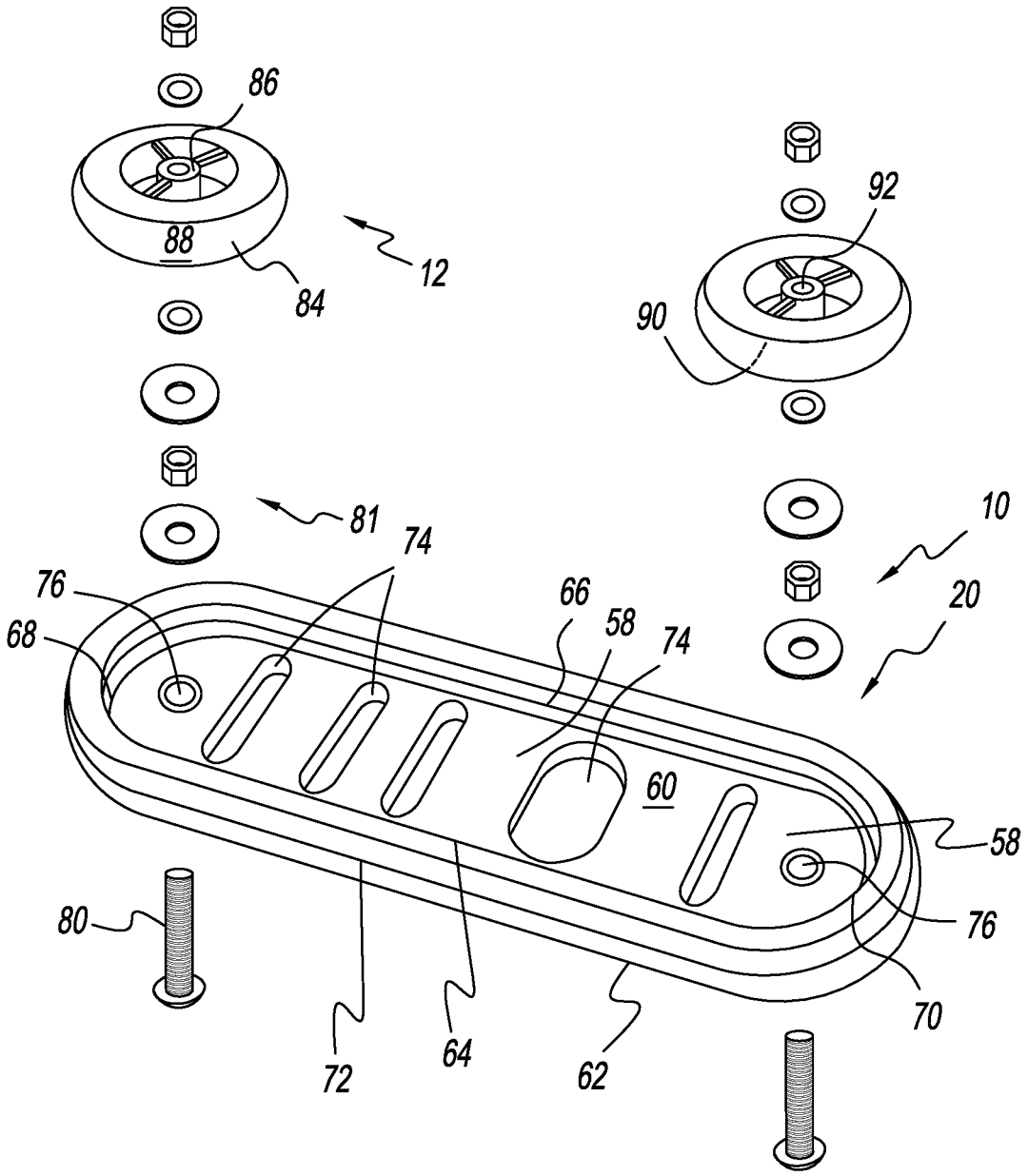
FIG. 2 is an exploded view of a skid shoe system.
Figure 3:
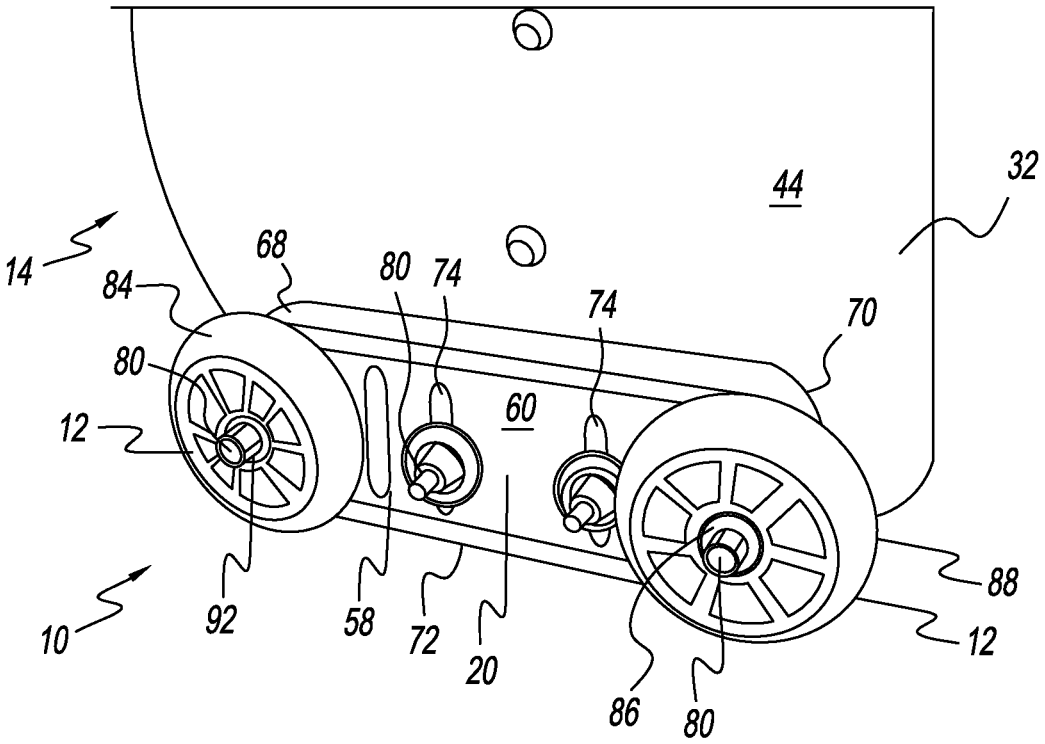
FIG. 3 is a perspective view of a skid shoe system connected to a snow blower.
Figure 4:
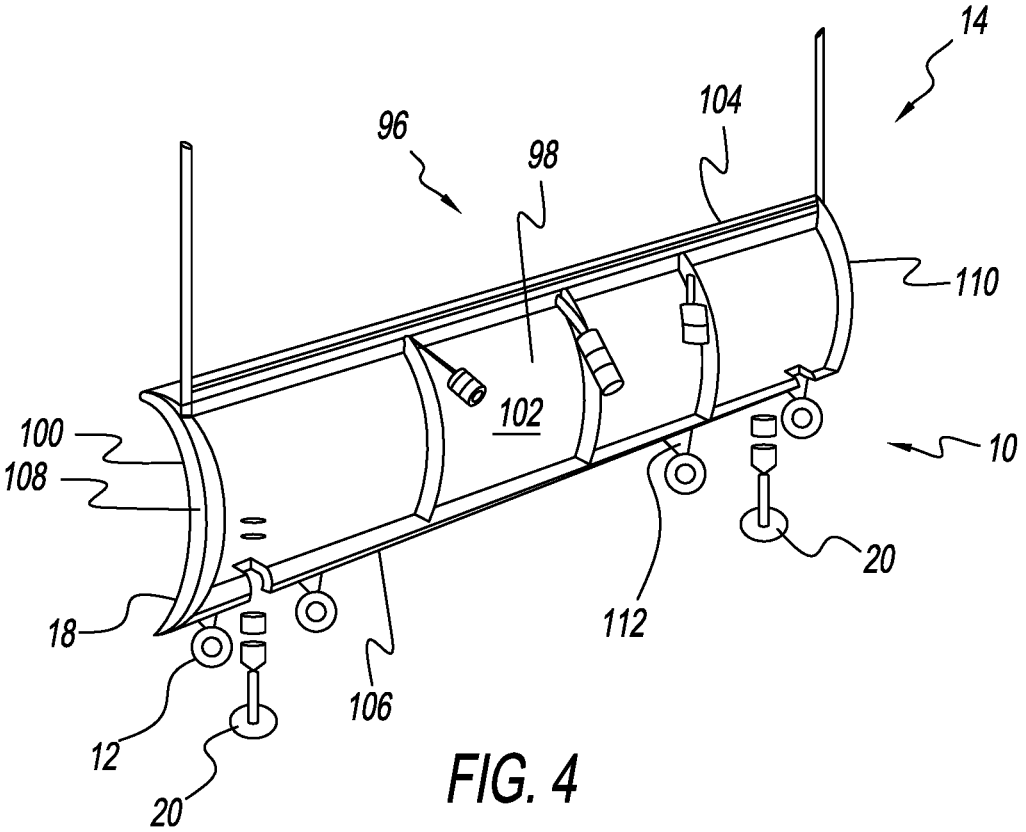
FIG. 4 is a perspective view of a skid shoe system connected to a blade of a snow plow.

For snow plows 18 that have a scoop 96 as shown in FIG. 2, the scoop 96 has a blade 98, which in various arrangements is angled, arcuate, or both. The blade 98 has a front surface 100 and a rear surface 102, and a top edge 104 and a bottom edge 106 that extend between a first side 108 and a second side 110 of the blade 98.

Each skid wheel 12 is connected to a bracket or suspension 112 that extends from the rear surface 102 of the blade 96. The brace 112 can be connected to the blade 98 in any manner, such as welding. In some embodiments, the brace 112 is spring-loaded to apply a downward force on the skid wheel 12. In other embodiments, each skid wheel 12 is connected through one wheel connection opening 76 in the brace 112. In these ways, the skid wheel 12 is partially positioned in a generally horizontal plane below the bottom edge 106 of the blade 98. One or more skid shoe 20 is also attached separately to the scoop 96 in some arrangements.

In some embodiments, the skid wheels 12 are positioned so that one skid wheel 12 is adjacent the first side 108 and another is positioned adjacent the second side 110. In other embodiments, more than two skid wheels 12 are connected along the length of the bottom edge 106 of the blade 98.

Therefore, a skid wheel system 10 has been provided that reduces or avoids wear to a snow removal device, avoids or reduces freezing and rusting, allows independent adjustment of the skid wheel system, extends the longevity of a snow removal device 14, assists a snow removal device 14 in traversing a terrain, reduces noise related to scraping, and improves upon the art.

From the above discussion and accompanying figures it will be appreciated that the skid wheel system 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A skid wheel system for attachment to an auger housing of a snow removal device, the skid wheel system comprising:

a) a skid shoe having a front, a back, a top, a bottom, a first side, and a second side; wherein the skid shoe is adapted to be attached to an auger housing of the snow removal device such that it extends below a lower surface of the auger housing and b) a first skid wheel connected to the skid shoe adjacent the first side of the skid shoe; and c) a second skid wheel connected to the skid shoe adjacent to the second side of the skid shoe;

wherein the circumferential edge of the first skid wheel and the second skid wheel extends below the bottom, and protrudes beyond the sides, of the skid shoe, so as to protect the bottom, front and rear of the housing of the snow removal device from contact with concrete seams, and other uneven surfaces.

2. The system of claim 1 further comprising at least one connection opening positioned through the front and the back of the skid shoe, wherein the at least one connection opening is configured to receive at least one connection member to connect the skid shoe to the snow removal device.

3. The system of claim 1 wherein the circumferential edge of the first skid wheel and the second skid wheel also, extend past the top and the respective first side and second side of the skid shoe, to allow the skid wheel system to be removed, rotated and reattached, should, the skid shoes wear to the point of no longer protecting the bottom of the housing when traversing seams or uneven surfaces.

4. The system of claim 1 further comprising at least one connection member received through a first central opening in the first skid wheel and a first wheel connection opening of the skid shoe positioned adjacent the first side of the skid shoe and at least one connection member received through a second central opening in the second skid wheel and a second wheel connection opening of the skid shoe positioned adjacent the first side of the skid shoe.

5. The skid shoe system of claim 4 wherein the at least one connection opening is positioned between the first wheel connection opening and the second wheel connection opening.

6. The skid wheel system of claim 4 wherein the at least one connection member received through the first skid wheel is also received though at least one spacer positioned between the first skid wheel and the skid shoe.

7. The skid wheel system of claim 6 wherein the at least one spacer positions the first skid wheel away from the front of the skid shoe such that the first skid wheel and the skid shoe do not contact one another.

8. The skid wheel system of claim 1 further comprising the skid shoe having an outer ridge that extends around at least a portion of an exterior of the skid shoe.

9. The skid wheel system of claim 8 wherein the at least one connection member received through the first skid wheel is also received though at least one spacer positioned between the first skid wheel and the skid shoe, such that the first skid wheel is set away from the skid shoe and the outer ridge of the skid shoe in the same direction by the spacer.

10. The skid wheel system of claim 1 further comprising the skid wheel having a tire and a bearing.

11. The skid wheel system of claim 10 wherein the tire is made of a polyurethane having a hardness of 85 A.

12. The skid wheel system of claim 10 wherein an outer surface of the tire has a rounded profile that is configured to engage a ground surface.

13. The skid wheel system of claim 2 wherein there are at least five connection openings.

14. The skid wheel system of claim 4 wherein the at least one connection opening is elongated in a vertical direction between the top and the bottom of the skid shoe, and the wheel connection opening is circular.

15. The skid wheel system of claim 1 wherein the first skid wheel and the second skid wheel are configured to reduce wear on the skid shoe and the snow removal device caused by engagement with a ground surface.

* * * * *